US007639127B2

(12) United States Patent
Kästli

(10) Patent No.: US 7,639,127 B2
(45) Date of Patent: Dec. 29, 2009

(54) METHOD FOR DETERMINING THE POSITION OF DEVICES IN A HAZARD DETECTION SYSTEM

(75) Inventor: Urs Kästli, Männedorf (CH)

(73) Assignee: Siemens Aktiengesellschaft, Munich (DE)

( * ) Notice: Subject to any disclaimer, the term of this patent is extended or adjusted under 35 U.S.C. 154(b) by 298 days.

(21) Appl. No.: 11/815,713

(22) PCT Filed: Jan. 5, 2006

(86) PCT No.: PCT/EP2006/050054

§ 371 (c)(1),
(2), (4) Date: Aug. 23, 2007

(87) PCT Pub. No.: WO2006/082119

PCT Pub. Date: Aug. 10, 2006

(65) Prior Publication Data

US 2008/0258905 A1 Oct. 23, 2008

(30) Foreign Application Priority Data

Feb. 7, 2005 (EP) ..... 05002480

(51) Int. Cl.
*G08B 26/00* (2006.01)

(52) U.S. Cl. ..... 340/505

(58) Field of Classification Search ..... 340/505, 340/825.52, 518, 825.57, 3.6, 632; 370/241, 370/252, 254, 257
See application file for complete search history.

(56) References Cited

U.S. PATENT DOCUMENTS

| | | | | |
|---|---|---|---|---|
| 6,348,856 | B1 * | 2/2002 | Jones et al. | 340/10.1 |
| 6,720,876 | B1 * | 4/2004 | Burgess | 340/568.1 |
| 6,838,999 | B1 * | 1/2005 | Ropke | 340/825.52 |
| 2001/0011892 | A1 * | 8/2001 | Ropke | 324/519 |

FOREIGN PATENT DOCUMENTS

GB 2 319 373 A 5/1996

* cited by examiner

*Primary Examiner*—Phung Nguyen
(74) *Attorney, Agent, or Firm*—Laurence A. Greenberg; Werner H. Stemer; Ralph E. Locher

(57) ABSTRACT

In order to determine the position of a device newly introduced into a hazard detection system, the devices of which include an insulator and are connected to a control center by a warning line, the newly introduced device is interrogated multiple times from one side of the warning line. The insulator of a device with an already known topology is first opened, subdividing the warning line into two branches, and the branch wherein the newly introduced device is located is then determined. This interval halving process is repeated until the exact position of the newly introduced device is found. In its preferred implementation, the device is a hazard detector or an actuator.

8 Claims, 1 Drawing Sheet

METHOD FOR DETERMINING THE POSITION OF DEVICES IN A HAZARD DETECTION SYSTEM

BACKGROUND OF THE INVENTION

Field of the Invention

The present invention relates to a method for determining the position of a newly installed device in a hazard detection system, the devices of which have an isolator and are linked to a control centre by way of a signaling line.

Devices in this context in particular include hazard detectors, such as fire or gas detectors, but they can also be actuators, such as optical or acoustic alarm emitters, relays, alarm displays, transmission devices for forwarding alarms, etc. When the term detector is used in the description which follows it should not be understood as restrictive.

When a new detector is installed in an already operational network, its position must be determined within the topology. This can be done by determining the overall topology by restarting the entire network, for example by means of a specific command to all detectors or no-load switching of the signaling line. The alarms are then started up in sequence, each being allocated a unique communication address. Such methods are known as chain synchronization or daisy chain and have been used for a long time. See also EP-A-0 042 501 for example.

EP-A-0 485 878 describes a method for determining the configuration of detectors in a hazard detection system, wherein the control centre has to implement a number of steps before the communication addresses are assigned to the detectors, which takes a relatively long time. Determining the position of a newly installed detector by restarting the entire network is time-consuming, particular in the case of larger networks, and is definitely not efficient.

EP-A-0 880 117 describes a method for the automatic location of detectors, wherein the detectors are equipped with means for communicating with adjacent detectors. To locate a detector, all the detectors open up their disconnectors and the detector to be located transmits a corresponding message, which is only received by its neighbors. The disconnectors are then closed and it is determined which detectors are those neighbors, allowing unique determination of the position of the detector to be located. This method is relatively fast but requires that the detectors are equipped with the said communication means.

SUMMARY OF THE INVENTION

The invention is intended to specify a method of the type mentioned above, which allows fast and simple location of newly installed devices and requires no further equipping of the devices.

The stated object is achieved according to the invention in that the newly installed device is scanned a number of times from one side of the signaling line, with the isolator of a device already known in the topology being opened previously and the signaling line thereby being divided into two branches and it is determined in which of the branches the newly installed device is located and this method is continued until the precise position of the newly installed device is located.

A first preferred embodiment of the inventive method is characterized in that first the isolator of a device disposed as close as possible to the centre of the signaling line is opened and it is then determined based on the availability of the newly installed device from the selected end of the signaling line whether it is in the branch before or after the device with the opened isolator.

A second preferred embodiment of the inventive method is characterized in that the isolator just opened is then closed and the isolator of a device disposed as close as possible to the centre of the branch of the signaling line containing the newly installed device is opened and it is determined based on the availability of the newly installed device from the selected end of the signaling line whether the newly installed device is before or after the device with the opened isolator.

A third preferred embodiment of the inventive method is characterized in that the described method of interval halving is implemented until the precise position of the newly installed device is established, which in the case of a hazard detection system containing a total of n detectors is after (log 1/n)/(log ½) steps, rounded to the nearest natural number. Thus for 30 detectors after 5 steps and for 100 detectors after 7 steps, each only lasting in the order of one second. It therefore only takes a short period of several seconds without any additional outlay to locate the precise position of the newly installed device.

BRIEF DESCRIPTION OF THE SEVERAL VIEWS OF THE DRAWING

The invention is described in more detail below with reference to an exemplary embodiment and the drawings, in which.

DESCRIPTION OF THE INVENTION

Figure 1:
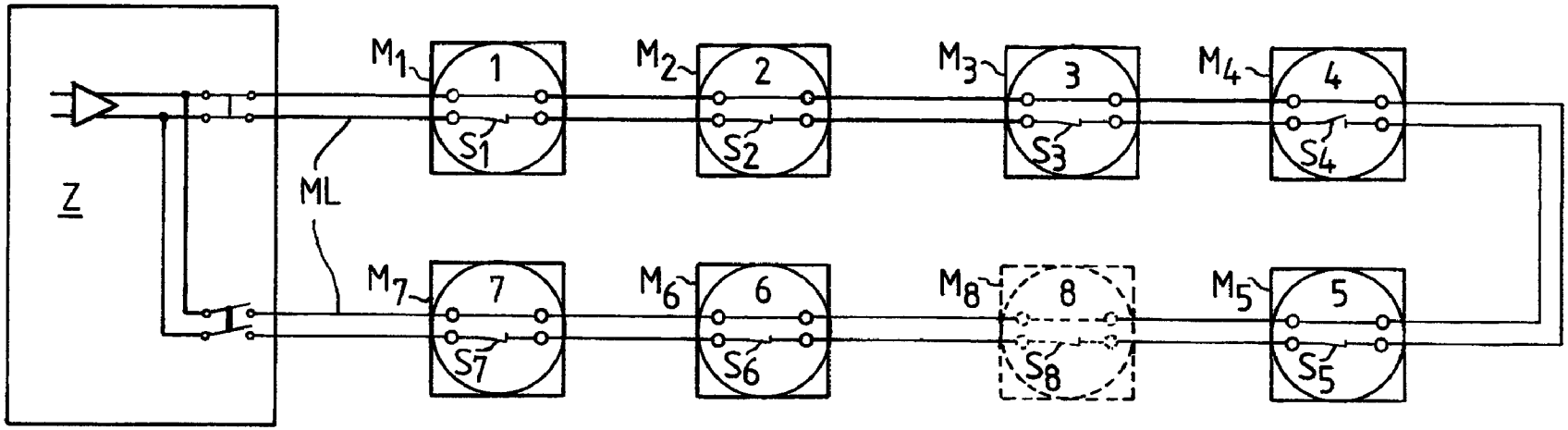
FIG. 1 shows a schematic diagram of a hazard detection system in a state representing a first step of the inventive method.
Figure 2:
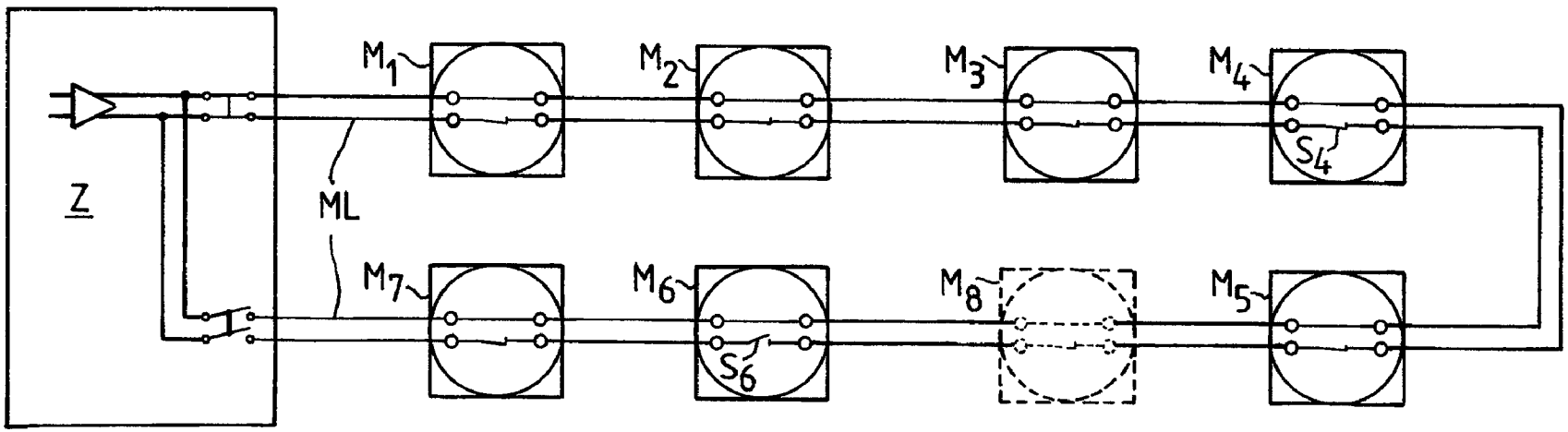
FIG. 2 shows the hazard detection system in FIG. 1 in a state representing the second step of the inventive method.

FIGS. 1 and 2 show a hazard detection system, comprising a control centre Z, a ring signaling line ML going out from this and detectors $M_1$ to $M_8$ linked to the signaling line ML. Let the detector $M_1$ have the communication address 1, the detector $M_2$ the communication address 2, etc. Each of the detectors $M_1$ to $M_8$ essentially contains at least one sensor for a hazard parameter, such as smoke, temperature or a combustion gas, an electronic evaluation system (both not shown) and an isolator $S_1$ to $S_8$.

As already mentioned in the introduction, detectors M refer not only to a hazard detector but quite generally to an addressable device installed in a signaling line. As well as a hazard detector it can also be an actuator, such as an optical or acoustic alarm emitter, a relay, an alarm display, a transmission device for forwarding alarms, etc.

Let it be assumed that the detector $M_8$ with the communication address 8 is a newly installed detector. The detector $M_8$ is scanned a number of times from one end, according to the diagram the upper end of the signaling line ML, to determine its position. The isolator of a detector already known in the topology is thereby previously opened in each instance. In a first step a detector is selected for this purpose, which is as close as possible to the centre of the signaling line ML. According to FIG. 1 this is the detector $M_4$ with the isolator $S_4$. It is then investigated whether the searched for newly installed detector is available from the selected end of the signaling line ML. This provides the information whether the searched for detector $M_8$ is located before or after the detector $M_4$ with the opened isolator $S_4$.

In the case of the exemplary embodiment shown the newly installed detector $M_8$ is not available from the upper end of the signaling line ML due to the opened isolator $S_4$, so it must be located in the branch after the detector $M_4$. The isolator $S_4$ of the detector $M_4$ is then closed and the interval halving method is continued in the branch after the detector $M_4$. According to FIG. 2 the isolator of a central detector of this branch is then opened, according to the diagram the isolator $S_6$ of the detector $M_6$, and this provides the information that the searched for detector $M_8$ is between the detectors $M_4$ and $M_6$, in other words it is one of the detectors $M_5$ or $M_N$.

By closing the isolator $S_6$ of the detector $M_6$ and then opening the isolator $S_5$ of the detector $M_5$, the newly installed detector $M_8$ is finally located precisely after only three steps in all.

It can generally be said that for a hazard detection system containing a total of n detectors, it takes (log 1/n)/(log ½) steps, rounded to the nearest natural number, to locate a newly installed detector, in other words for 30 detectors 5 steps and for 100 detectors 7 steps, each only lasting in the order of a second.

It therefore only takes a short period of several seconds without any additional outlay to locate the precise position of the newly installed detector.

The inventive method is not restricted to a ring signaling line ML of the type shown in FIGS. 1 and 2 but can also be used with what are known as spur lines or branch lines. If for example a spur line containing a newly installed detector were branched from the signaling line ML between two detectors, the described method could be used to determine the site of the branch and the same method could then be used to determine the position of the newly installed detector on the spur line.

The invention claimed is:

1. A method for determining a position of a newly installed device in a hazard detection system, which comprises:

a) providing a system with a control center and a plurality of devices each having an isolator and each being linked to the control center by way of a signaling line;

b) opening the isolator of a given one of the plurality of devices, a location of which is known within the system, and thereby dividing the signaling line into two branches; and c) scanning the newly installed device a number of times from one side of the signaling line, and determining which of the two branches contains the newly installed device; and d) repeating steps b) and c) until a precise location of the newly installed device in the system is determined.

2. The method according to claim 1, which comprises first opening the isolator of a given device disposed as close as possible to a center of the signaling line and then determining, based on an accessibility of the newly installed device from a selected end of the signaling line, whether the newly installed device is located in the branch before or after the device with the opened isolator.

3. The method according to claim 2, which further comprises closing the opened isolator and subsequently opening the isolator of a device disposed as close as possible to a center of the branch of the signaling line containing the newly installed device, and determining, based on the accessibility of the newly installed device from the selected end of the signaling line whether the newly installed device is located before or after the device with the opened isolator.

4. The method according to claim 3, which comprises continuing with the method of halving the interval until the precise position of the newly installed device is determined.

5. The method according to claim 3, which comprises, for a hazard detection system containing a total of n detectors, continuing steps b) and c) for a number/(log ½) steps, rounded to a nearest natural number.

6. The method according to claim 1, which comprises providing a hazard detector selected from the group consisting of a fire or gas detector or an actuator.

7. A method for determining a position of a newly installed device among a plurality of like devices in a hazard detection system, the hazard detection system having a control center and a plurality of devices each having an isolator and each being linked to the control center by way of a signaling line that is interruptible at each respective isolator, the method which comprises:

opening the isolator of a given one of the plurality of devices, a location of which is known within the system, and thereby dividing the signaling line into a first branch and a second branch;

scanning for the newly installed device a number of times on the first branch and/or on the second branch of the signaling line and determining that the newly installed device is connected in the first branch or in the second branch;

opening the isolator of one of the devices in the branch of the signaling line in which the newly installed device was found in the scanning step; and repeating the scanning step and, optionally opening further isolators, until a precise location of the newly installed device in the system has been determined.

8. The method according to claim 7, which comprises first opening the isolator of a given device disposed approximately in a center of the signaling line and dividing the signaling line into two branches each containing a substantially equal number of devices in each of the opening step.

* * * * *